United States Patent [19]

Martyshenko et al.

[11] Patent Number: 4,701,075

[45] Date of Patent: Oct. 20, 1987

[54] REINFORCED CONCRETE OFFSHORE PLATFORM

[75] Inventors: Jury P. Martyshenko, Novopolotsk; Sergei J. Martyshenko; Jury S. Kotelnikov, both of Rostov-na-Donu; Evgeny G. Kutukhtin, Moscow; Nelli I. Ilyasova, Rostov-na-Donu; Jury S. Volkov; Armenak M. Vardanian, both of Moscow; Misha S. Petrosian, Simferopol, all of U.S.S.R.

[73] Assignee: Novolipetsky Politekhnichersky Institut Imeni Leninskogo Komsomola Belorusii, Novolipetsk, U.S.S.R.

[21] Appl. No.: 809,890

[22] PCT Filed: Apr. 12, 1985

[86] PCT No.: PCT/SU84/00019

§ 371 Date: Nov. 21, 1985

§ 102(e) Date: Nov. 21, 1985

[87] PCT Pub. No.: WO85/04683

PCT Pub. Date: Oct. 24, 1985

[51] Int. Cl.[4] ..... E02D 21/00; E02D 25/00; E02D 27/38

[52] U.S. Cl. ..... 405/217; 405/204; 405/210

[58] Field of Search ..... 405/195, 203–210, 405/217, 222, 223, 224, 211, 61; 52/79.4, 227, 228, 236.1

[56] References Cited

U.S. PATENT DOCUMENTS

| | | | |
|---|---|---|---|
| 3,472,031 | 10/1969 | Kelso | 52/227 X |
| 3,698,198 | 10/1972 | Phelps | 405/204 |
| 3,913,335 | 10/1975 | Heier | 405/210 |
| 4,037,423 | 7/1977 | Knutsen | 405/205 |
| 4,422,804 | 12/1983 | Gerwick | 405/210 |
| 4,448,570 | 5/1984 | Berthin | 405/204 |
| 4,511,288 | 4/1985 | Wetmore | 405/204 X |

FOREIGN PATENT DOCUMENTS

| | | | |
|---|---|---|---|
| 2647330 | 8/1978 | Fed. Rep. of Germany | 405/204 |
| 2440442 | 7/1980 | France | 405/204 |
| 1509503 | 5/1978 | United Kingdom | 405/204 |

OTHER PUBLICATIONS

"Order In Space", Keith Critchlow, C 1969, Appendix 2.

*Primary Examiner*—Cornelius J. Husar
*Assistant Examiner*—Nancy J. Stodola
*Attorney, Agent, or Firm*—Burgess, Ryan and Wayne

[57] ABSTRACT

An offshore platform comprises a honeycomb foundation (A), a supporting structure (B) and an above-surface section (C), the foundation and the supporting structure being made of prefabricated reinforced concrete elements which are polyhedral hollow prisms (1, 2) set with gaps (6) between the external faces thereof. The prisms (1, 2) are joined by a system of prestressed vertical and horizontal diaphragm walls (4, 3) formed by pre-tensioning reinforcing bars (7, 8) placed in the gaps (6) between the faces of the prisms (1, 2) and casting-in-situ the gaps (6) later on.

4 Claims, 11 Drawing Figures

REINFORCED CONCRETE OFFSHORE PLATFORM

FIELD OF THE INVENTION

This invention relates to civil engineering and, in particular, to offshore platforms designed for carrying technological equipment and life-support system packages in development of continental shelves.

PRIOR ART

At present such offshore platforms are mainly made from steel and reinforced concrete. The latter is thought to be better suited for freezing seas, particularly prestressed reinforced concrete. It possesses such indispensable properties as strength, water-tightness, fire-resistance, durability, endurance, rigidity, resistance to subzero temperatures, wear-resistance and many others making it a highly effective material and sometimes the only one which could be used for offshore structures. Concrete in submersible structures becomes even stronger due to the volume stress produced by the hydrostatic pressure at depth. Local damage of reinforced concrete can very often be easily repaired.

Reinforced concrete submersible platforms for offshore recovery of mineral wealth can be towed to a new location after the resources of the old one are exhausted. New deposits can be industrially exploited at a minimal cost by using mobile platforms.

These platforms are made of cast-in-place concrete. Prefabricated components can only be used for some floor beams, breakwater parts and central shaft sections.

Known in the art is a cast-in-place reinforced concrete offshore platform comprising an equipment deck, supporting columns and a honeycomb caisson foundation. The platform foundation is used to transfer oil storage and ballasting in order to make the platform rest more stably on the sea bottom. The platform is built in slip forms, initially in a dry dock or a pit and later on in a shipyard. The completed platform is towed afloat to a selected location.

Such platforms are designed and constructed for mild weather conditions only. In addition, making cast-in-situ reinforced concrete structures in slip forms in harsh winter climates of Arctic and Far East regions presents numerous difficulties or is next to impossible to realize at all.

Also known in the art is a sectional reinforced concrete offshore platform comprising a honeycomb foundation, a support and an above-water structure. It also comprises a bottom slab, annular and radial partitions and a side shell.

A large variety of types and sizes of section elements and a multitude of extended joints packed with reinforcements are certainly disadvantages of this platform. Joints can be cast with concrete but the quality of such casting-in-situ is usually low and the durability of the structure is affected. It can even invite accident.

BRIEF DESCRIPTION OF THE INVENTION

It is an object of the invention to provide an offshore platform wherein the design of the principle components ensures better three-dimensional rigidity, greater bearing strength, improved resistance to ice push, and makes it easier to build such structures in severe weather conditions.

There is provided a reinforced concrete offshore platform comprising a honeycomb foundation, a supporting structure and an above-surface section to carry the equipment, wherein, according to the invention, the foundation and the supporting structure are made of prefabricated reinforced concrete elements which are polyhedral hollow prisms set with gaps between the external faces thereof and integrated by a system of prestressed vertical and horizontal diaphragm walls made by prestressing the reinforcement bars in the gaps between the prism faces and casting it with concrete later on.

In one of the embodiments of this invention each prism features cantilever ledges on side faces, the prestressed reinforcement bars arranged in the gaps between the prisms being made tight over said ledges.

In another embodiment of this invention prisms are secured to the bottom of the platform foundation along the perimeter thereof, one side of said prisms, which faces the sea floor, being split open.

One more embodiment of this invention has the honeycomb foundation, supporting structure and above-surface section assembled from said prisms joined into large-size modules.

This design ensures three-dimensional rigidity of the structure, adequate bearing strength and reliability, and a much shorter period for construction.

This is achieved in that the honeycomb foundation and the supporting structure are assembled from prefabricated reinforced elements which are polyhedral (trihedral, for example) hollow prisms whose geometrical shape is permanent. The structure is reliable because each prismatic component is sufficiently leakproof, and, if one or several prisms break up, no emergency occurs and prefabricated elements junction is simplified. The three-dimensional rigidity and the rugged bearing strength of the platform are also ensured by a system of prestressed vertical and horizontal diaphragm walls which integrate prefabricated components and take the external forces.

The diaphragm walls are formed by prestressing horizontal and vertical reinforcing bars arranged in the gaps between the sides of the prisms, cast with concrete later on. The tension of the tendons is transferred onto cantilever ledges provided on the sides of the prisms. The final result is a three-dimensionally prestressed structure. Laboratory tests of a platform model made according to the invention have proved it to be a very effective construction.

Prismatic components can actually be manufactured at any concrete product plant, whatever the distance to the future location of the platform, so that no special complex equipment is required. Production facilities are much cheaper to organize and put into operation. Platforms are assembled of prefabricated three-dimensional elements thus minimizing the effects of the severe climate on construction quality and rate.

When a platform is assembled of large-size modules, the time for towing the platform from the shipyard to the location can be drastically reduced and the trip becomes much safer in ice packed seas. The use of large-size modules can also help reduce the platform draught so that it can be installed in shallow waters, up to 15 or 20 meters.

This invention can bring about a 25–30 percent cut in the completion period alotted for the construction of a platform and in the labour input therefor. The existing concrete product plants can be made use of and still better quality of the final product can be achieved.

BRIEF DESCRIPTION OF DRAWINGS

Other advantages of the present invention will become apparent from the following detailed description in conjunction with the accompanying drawings illustrating practicable embodiments of this invention, wherein.

BEST MODE FOR CARRYING OUT THE INVENTION

An offshore platform according to the invention comprises a foundation A, one or several support structures B and an above-surface section C.

A reinforced offshore platform (FIGS. 1, 1*a*, 1*b*, 2) comprises prefabricated reinforced concrete components which are polyhedron hollow prisms, for example trihedron prisms 1 and 2, which are integrated by a system of vertical diaphragm walls 4 and horizontal diaphragm walls 3 made as cast-in-situ slabs.

Figure 1B:
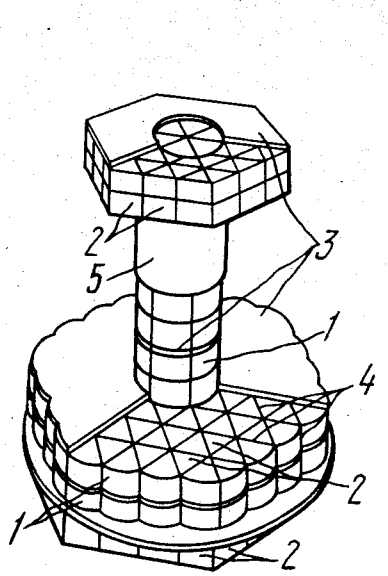
FIGS. 1, 1*a* and 1*b* show embodiments of a reinforced concrete offshore platform comprising trihedral hollow prisms.
Figure 1A:
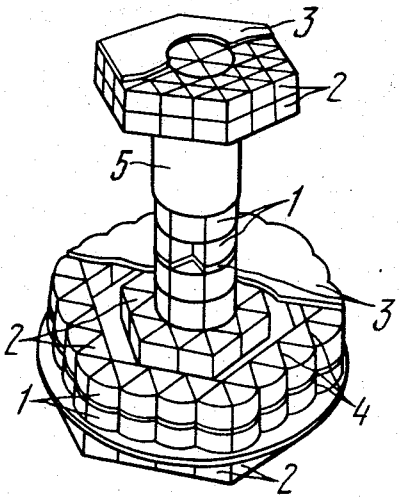

Platforms for deep sea locations are composed of two types of prisms 1 and 2 (FIGS. 1*a* and 1*b*). Prisms 1 are arranged along the perimeter of the platform, their external side being cylindrical. Internal prisms 2 have flat sides.

Figure 1:
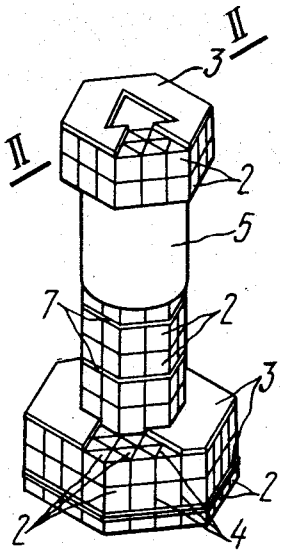
Figure 2:
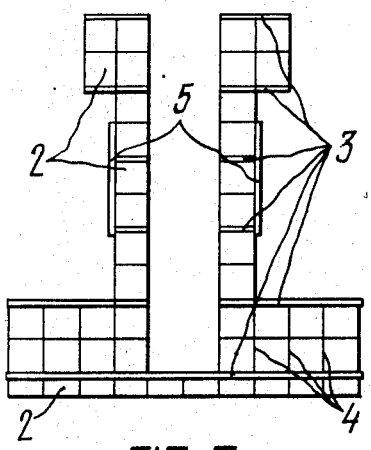
FIG. 2 shows a view taken along line II—II of FIG. 1.

In an embodiment intended for shallow waters the foundation A and the support B are assembled of similar prisms 2 (FIG. 1). The support B can be made stronger by impregnation by a polymer 5.

The above-water section C of the platform can be either prisms 1 or 2 made of light-weight concrete or metalwork.

The platform foundation can be assembled of prisms laid out in different patterns (FIGS. 1, 1*a* or 1*b*).

The bottom plate of the foundation (the bottom slab) is built in a shipyard or a dry dock as follows.

Figure 3:
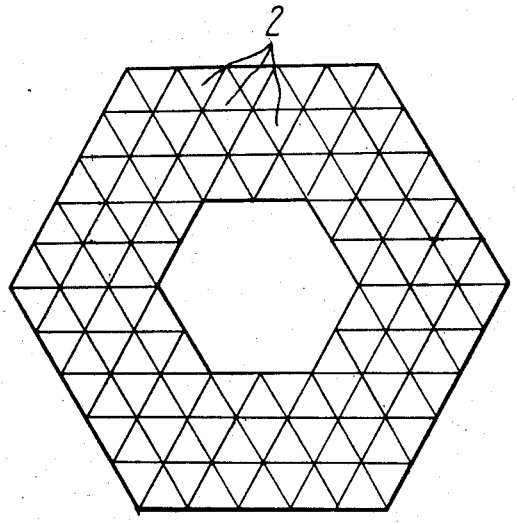
FIG. 3 shows an embodiment of a platform foundation comprising trihedral prisms.
Figure 4:
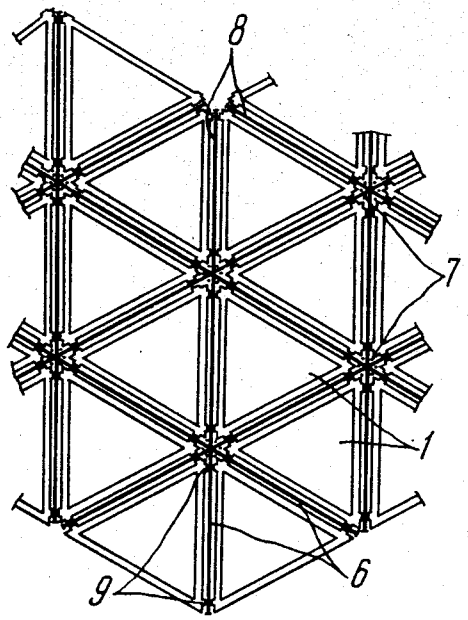
FIG. 4 shows a fragment of a pattern in which the prisms are assembled to erect a platform foundation, the prestressed reinforcement bars being placed in the gaps between said prisms.

At first, prisms 2 are arranged so that their opened sides face downwards (FIG. 3) and gaps 6 (FIG. 4) are provided between their external sides so that prestressed and unstressed vertical reinforcing bars 7 and horizontal reinforcing bars 8 can be fit in said gaps 6. Then the reinforcing tendons are pre-tensioned on the specially provided cantilever ledges 9 provided for the purpose on the side faces of the prisms 2 (FIG. 4). The gaps are then filled with concrete. In this way vertical monolithic diaphragm walls are produced. The horizontal reinforcing bars are then placed on the top edges of the prisms. Some of the horizontal reinforcing bars, together with free lengths of the vertical reinforcement bars, are pre-tensioned on the cantilever ledges of the prisms to be later cast-in-place with concrete to form a monolithic horizontal diaphragm slab 3 (FIG. 1). Here the top edges of the prisms are used as formwork. Finally, all prisms are integrated by a system of vertical and horizontal cast-in-place diaphragm walls prestressed in three dimensions into a single honeycomb structure.

In one of the embodiments, embedded metals are provided along the perimeter of prism faces so that later, during the assembly process, they can be welded together by means of straps or plates.

The concrete casting being over, the bottom plate is towed to a protected water area. The buoyancy of the bottom plate is due to the air trapped in the prisms.

The structure of the bottom plate is specifically aimed at preventing the sea floor from being washed out, since the prism ribs facing downward cut into the soil when the platform is set on a location.

After the platform is placed in a harboured water area, the next stage of foundation building starts.

Prisms are arranged on the bottom plate in the pattern described above. The vertical reinforcement bars placed in the gaps between the prism sides are to be joined with the free lengths of the reinforcement bars extending from the bottom plate. The number of prism tiers is dictated by the depth of water at the platform future location. The building process is completed by a horizontal diaphragm slab 3 (FIG. 1).

The foundation this built is a honeycomb structure prestressed in three dimensions.

Similar procedure is used to erect supports or large-size support modules. If the platform is designed for locations where the sea level is variable and the ice hazard is thought to be substantial, the supports can be protected by an external cast-in-place reinforced concrete shell shielded by a metal sheet or reinforced concrete plates impregnated with polymer materials 5 (FIG. 1).

The honeycomb part of the foundation is used for keeping a ballast or oil and gas. The inner space of the support is to hold equipment or be used for various technological support operations. For the purpose, all prisms are interconnected by a system of pipelines and windows in prism walls. The above-surface section of the platform carries technological equipment, living quarters and life support systems.

If a platform is built in shallow waters, large-size modules are erected in any convenient place at a shipyard or a dry dock. The modules are then towed to the platform location or brought there by any floating means to be assembled into a single structure on the spot.

When a platform is to be built in deep waters, the bottom plate is assembled and cast with concrete in a shipyard, a dry dock or a pit, as has been described above. The bottom plate is then towed to a conveniently deep sea area where the platform is completed. It is then towed to a selected location.

Figure 5:
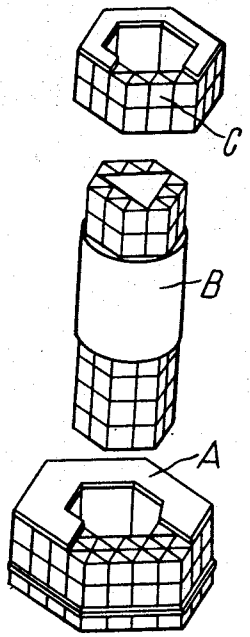
FIGS. 5 and 5*a* show variants of platforms composed of large-size modules.
Figure 5A:
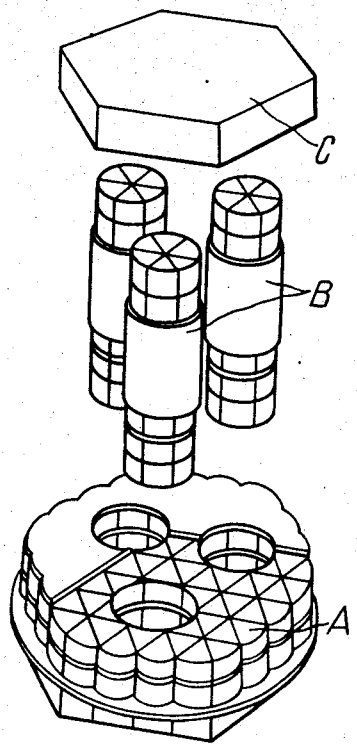

A platform can be assembled from large modules A, B and C (FIGS. 5 and 5*a*) as follows. A deep sea site is selected near the location. The platform foundation module A is then ballasted to sink to an appropriate depth. The module of the support B is towed and placed floating over the foundation module A. The support module B is ballasted to fit into the opening in the foundation module A. The above-surface structure C is likewise placed upon the platform (FIG. 5). The whole of the platform is then made to float at a specific draught by dropping a part of the ballast and can be towed in the permanent location.

Figure 6:
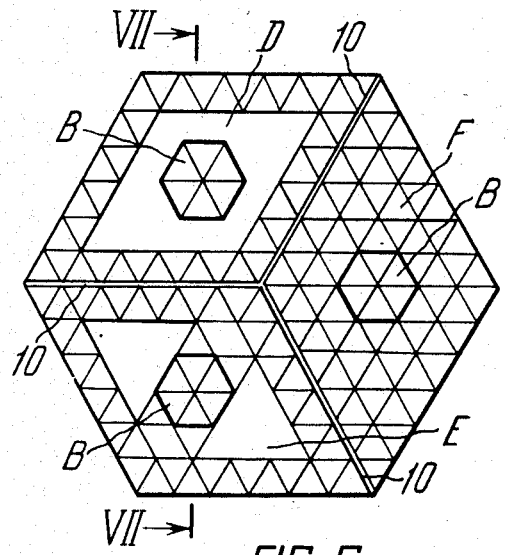
FIG. 6 shows an embodiment of a platform being divided into three rhombiform modules.
Figure 8:
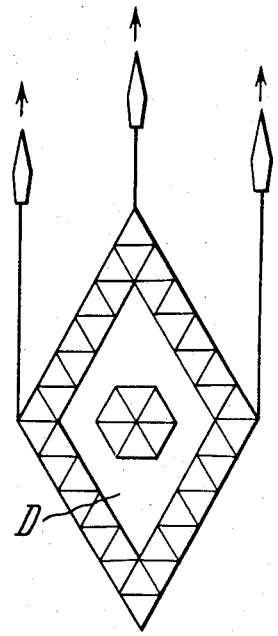
FIG. 8 shows schematically towing of a rhombiform module.
Figure 7:
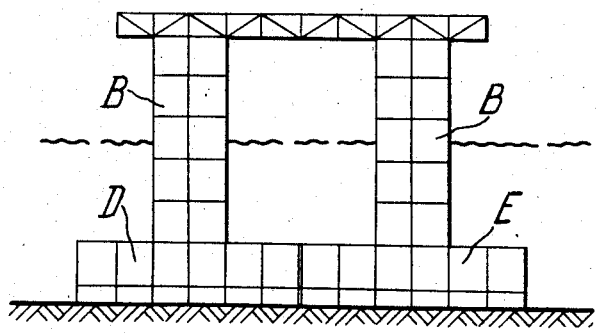
FIG. 7 shows a view taken along line VII—VII of FIG. 6.

In one of the embodiments the platform is sectionalized, for convenience of building, into rhomb-shaped modules D, E and F (FIG. 6). Each module, in this case, comprises a foundation-caisson and a support (FIGS. 6, 7 and 8).

Prisms can be arranged differently in the foundation of the rhomb-shaped modules. FIG. 6 shows three different types of prism arrangement patterns. Thus, for example, in the module D (FIG. 6) prisms are placed along the rhomb perimeter to form the shell of the module foundation. The space between the support B and the shell-forming prisms remains unoccupied and is overlapped by a reinforced concrete slab.

In the module E an additional row of prisms is placed between the support B and the shell-forming prisms along the shorter diagonal of the rhomb in order to make the structure still more rigid.

In the module F prisms are arranged all over the foundation floor area.

The prism arrangement pattern illustrated by the module D is advisable for shallow waters, when the hydrostatic pressure is relatively low. The prism arrangement pattern of the module F is preferable for higher hydrostatic pressures.

Modules are erected separately as described above and then towed (FIG. 8) to the platform location where they are fitted together by joints 10 (FIG. 6) to form an integral structure.

The offshore platform according to the invention is extremely rigid in three dimensions and is capable of withstanding substantial ice, wave, wind, seismic and other loads due to the system of prestressed vertical and horizontal diaphragm walls. Moreover, a platform composed of prefabricated prism components can be built in severe arctic conditions irrespective of the time of the year.

We claim:

1. A reinforced concrete offshore platform comprising a honeycomb foundation (A), a supporting structure (B) and an above-surface section (C) carrying appropriate equipment, characterized in that the honeycomb foundation (A) and the supporting structure (B) are made of prefabricated reinforced concrete elements which are polyhedral hollow prisms (1, 2) arranged with gaps (6) between the external sides thereof and joined by a system of prestressed vertical diaphragm walls (4) and horizontal diaphragm walls (3) formed by pre-tensioning reinforcing bars (7, 8) placed in the gaps (6) between the faces of the prisms (1, 2) and casting-in-situ said gaps later on.

2. A reinforced concrete offshore platform as claimed in claim 1, characterized in that each prism (1, 2) is provided with cantilever ledges (9) on the side faces thereof, while the prestressed reinforcing bars (7, 8) placed in the gaps (6) between said prisms (1, 2) are tensioned on said ledges (9).

3. A reinforced concrete offshore platform as claimed in claim 1, characterized in that prisms (2) having one side opened and facing downward are arranged along the perimeter of the bottom of the platform foundation (A).

4. A reinforced concrete offshore platform as claimed in claim 1, characterized in that there are a plurality of honeycomb foundations, supporting structures and above-surface sections intergrated together into a large-size offshore platform.

* * * * *